United States Patent [19]

Pott et al.

[11] Patent Number: 4,960,137

[45] Date of Patent: Oct. 2, 1990

[54] METHOD AND APPARATUS FOR FORMING CURVED HANDRAILS

[75] Inventors: Ronald W. Pott, Lakewood; William G. Grimm, Evergreen, both of Colo.

[73] Assignee: R.W. Investment Co., Commerce City, Colo.

[21] Appl. No.: 400,868

[22] Filed: Aug. 28, 1989

[51] Int. Cl.[5] ..... B27D 1/00

[52] U.S. Cl. ..... 144/349; 144/269; 144/344; 144/352; 156/222; 156/228; 269/43; 269/249

[58] Field of Search ..... 144/254, 259, 269, 344, 144/346, 352, 349; 156/222, 228; 269/43, 249

[56] References Cited

U.S. PATENT DOCUMENTS

| | | | |
|---|---|---|---|
| 3,107,708 | 10/1963 | Savage | 144/327 |
| 3,733,055 | 5/1973 | Hughes | 256/59 |
| 3,835,904 | 9/1974 | Sumner | 144/313 |
| 3,879,026 | 4/1975 | Lappin | 269/55 |
| 3,902,948 | 9/1975 | Morros | 156/222 |
| 3,922,453 | 11/1975 | Seery | 428/44 |
| 4,132,391 | 1/1979 | Takenaga | 256/59 |
| 4,256,287 | 3/1981 | Birmingham | 256/59 |
| 4,602,766 | 7/1986 | Naka | 256/59 |
| 4,646,490 | 3/1987 | Naka | 52/184 |

FOREIGN PATENT DOCUMENTS 1728013 11/1975 Fed. Rep. of Germany ..... 144/349

*Primary Examiner*—W. Donald Bray
*Attorney, Agent, or Firm*—John E. Reilly

[57] ABSTRACT

An on-site fabrication method has been devised for compound bending of laminated wooden beam members into a handrail for curved or spiral stairways in which upstanding supports are positioned at intervals along the path of intended curvature on the stairway, the strips are assembled together in juxtaposed relation to one another and retained by leveling brackets on the support members whereby to prevent twisting of the beam members when a lateral force is applied, clamping the beam members together against each support member and permitting the beam members to be cured into a unitary rail section. In the preferred apparatus, right angle brackets are anchored to the tread portions with upstanding support members or legs disposed along the path of intended curvature, channel-shaped brackets are associated with the right angle brackets to apply pressure to the top and bottom surfaces of the beam members, and C-clamps apply a laterally directed pressure to clamp the beam members firmly against a closed end of each channel-shaped bracket and vertical leg of each right angle bracket.

13 Claims, 1 Drawing Sheet

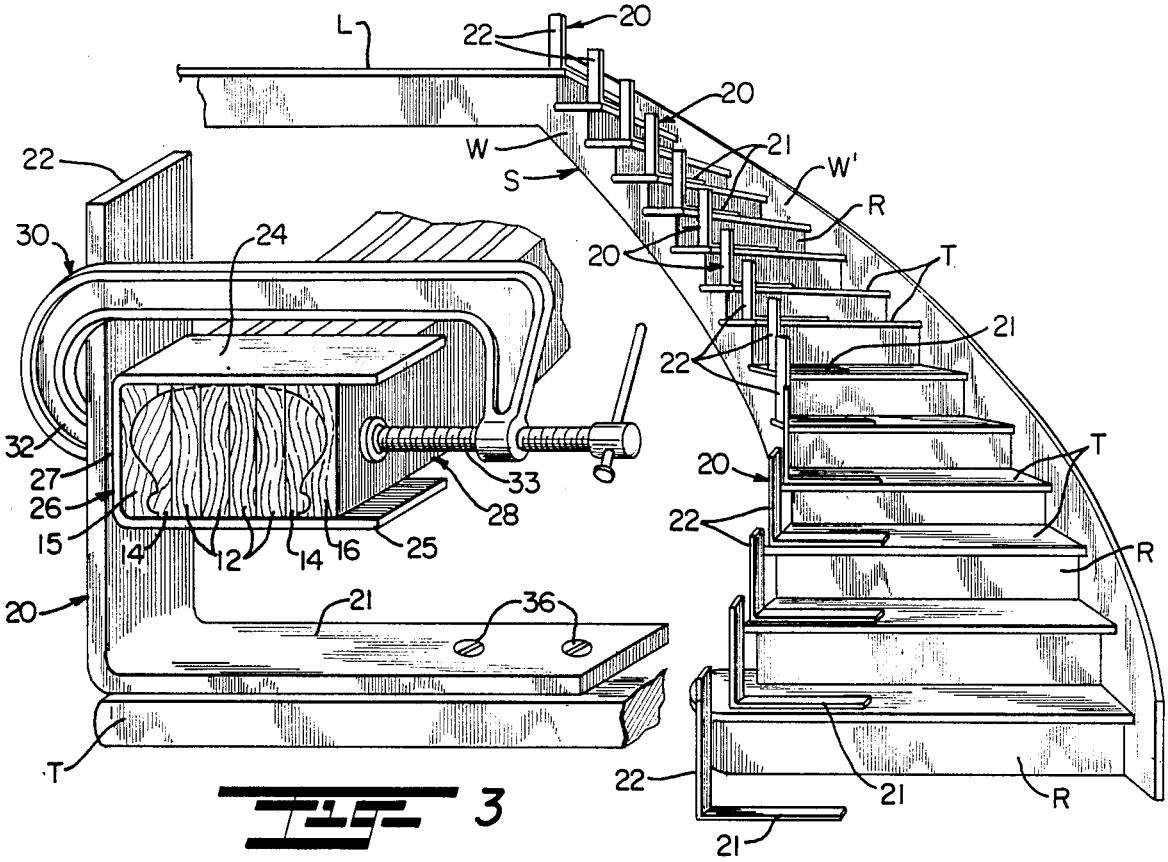
FIG. 3
FIG. 1
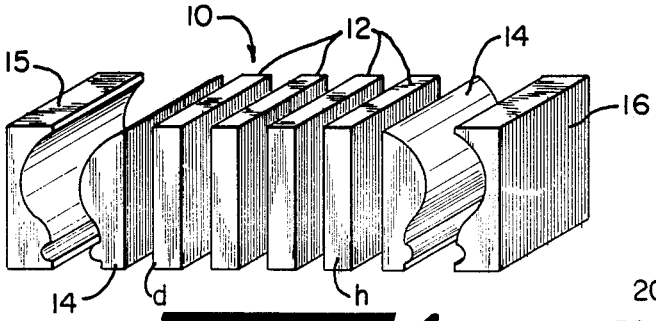
FIG. 4
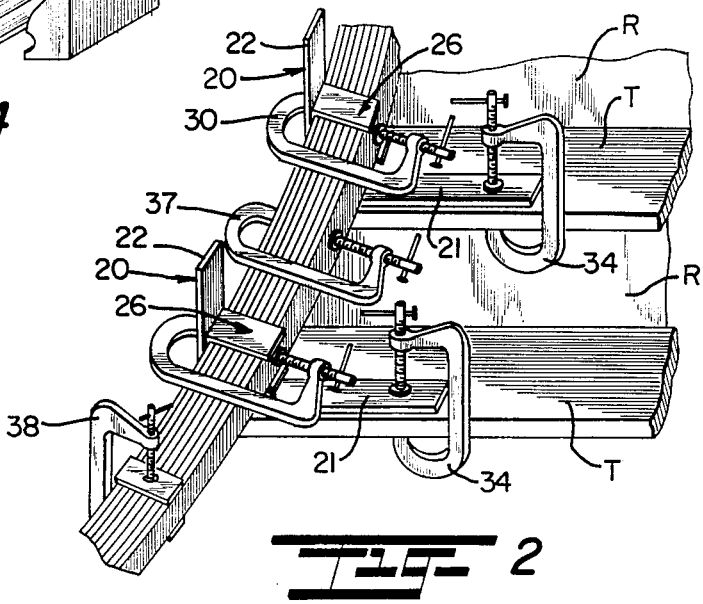
FIG. 2

METHOD AND APPARATUS FOR FORMING CURVED HANDRAILS

This invention relates to a method and apparatus for forming and bending wooden elements into compound curved articles; and more particularly relates to a novel and improved method and apparatus for the on-site fabrication and handling of laminated wood sections into curved handrails.

BACKGROUND AND FIELD OF INVENTION

It has been the practice to prefabricate handrails for use on curved or spiral stairways out of laminated wood sections. These rail sections must then be assembled at the site to conform to a particular desired curvature or pitch in accordance with the requirements and specifications at the intended site. It has also been proposed to custom fabricate handrails at the site in order to more readily conform to the particular specifications and to avoid the time and expense of packaging and shipping a wide variety of curved rail sections needed to meet different specifications. Whether the handrail is prefabricated or custom fabricated at the site, a particular problem confronting the fabricator is in forming the necessary compound curvature or bend in the rail which will avoid twisting of the rail when it is bent to conform to the slope and curvature of the stairway. In other words, when the handrail is bent to follow or conform to a particular curvature along a spiral or curved stairway, the slope of the stairway will tend to introduce an unwanted twist into the rail section about its own axis. This is especially true of handrails formed out of elongated, laminated strips of wood which are adhered together into a desired profile and allowed to cure or set into a particular configuration which will follow the curvature of the staircase.

Representative of the approaches taken in the past are U.S. Letters Pat. No. 3,107,708 to R. H. Savage which employs a steel form having an L-shaped cross-section and which must be curved or otherwise shaped into the configuration of the particular curvature of member to be formed and which is employed in combination with C-shaped clamps disposed at right angles to one another. U.S. Letters Pat. No. 3,879,062 to J. B. Lappin, Jr. exemplifies a somewhat different method of forming curved laminated rails using what is described as helical work holders or supporting units which can be adjusted into different positions above a common shaft. Other patents of general interest in this field are U.S. Letters Pat. Nos. 2,902,948 to J. Morros; 4,602,766 to H. Naka et al; 3,733,055 to W. J. Hughes, Jr.; 3,922,453 to R. F. Seery; 4,132,391 to S. Takenaga; 4,646,490 to H. Naka et al; 3,835,904 to J. S. Sumner and 4,256,287 to R. A. Birmingham. Nevertheless, there is lacking any suggestion or disclosure of an on-site forming method which avoids the use of specially contoured forms but enables compound bending in place of laminated wood sections into the desired curvature and pitch while overcoming problems of undesirable twisting and distortion of the section.

SUMMARY OF INVENTION

It is therefore an object of the present invention to provide for a novel and improved method and apparatus for forming elongated curved sections out of laminated wood strips.

It is another object of the present invention to provide for a method for on-site fabrication of curved handrails and which is conformable for use in forming handrails for spiral stairways of different curvatures and pitch.

A further object of the present invention is to provide for a novel and improved apparatus for forming laminated wooden curved structures on site in a dependable and efficient manner and which will prevent twisting of the wooden elements in conforming to different curves without requiring special equipment or accessories.

It is a further object to provide for a method and apparatus for forming curved handrails through the utilization of a combination of clamps and brackets in such a way as to be adaptable for use in forming and bending rail sections to varying pitches and curvatures.

It is an additional object of the present invention to provide for a novel and improved method and apparatus for forming curved handrails out of laminated wooden beams which is highly simplified and inexpensive and avoids the use of contoured molds or forms.

In accordance with the present invention, a preferred method of compound bending laminated wooden beam members into a curved rail section comprises the steps of joining elongated strips of wood of a desired length in juxtaposed relation to one another and to define the desired cross-sectional configuration of the rail, positioning upstanding support members at longitudinally spaced intervals along the stairway for which the rail section is being formed and anchoring the support members to the stairway along the line of intended curvature, adhesively securing the laminated strips together in juxtaposed relation to one another, positioning pressure pads on the support members to engage the laminated wooden strips, clamping the strips and each pad laterally against each support member with each pad disposed at the desired slope and applying pressure uniformly across the transverse dimension of a respective upper or lower surface of the rail section and permitting the laminated strips to be firmly adhered together into a curved handrail of the desired pitch and curvature.

In the preferred apparatus of the present invention, vertical support members are preferably constituted of right angle brackets having horizontal portions anchored to the tread portions of a stairway and vertical legs disposed along the path of intended curvature; pressure pads are defined by channel-shaped brackets for applying pressure to either or both the upper and lower surfaces of the laminated strips; and C-clamps for applying laterally directed pressure to clamp the laminated strips firmly against a closed end of each channel-shaped bracket and vertical leg of each right angle bracket. Preferably, the laminated strips are sandwiched between profile forms on opposite sides of the strips when inserted into each channel-shaped bracket so that pressure is uniformly applied across the width of the rail section at uniformly spaced intervals along its length.

The above and other objects, advantages and features of the present invention will become more readily appreciated and understood from a consideration of the following detailed description of a preferred embodiment of this invention when taken together with the accompanying drawings, in which:

BRIEF DESCRIPTION OF THE DRAWINGS

FIG. 1 is a somewhat perspective view of a spiral stairway illustrating the disposition of a series of vertical support members along the path of intended curvature of a rail section;

FIG. 2 is a somewhat fragmentary perspective view illustrating laminated strips sandwiched between profile forms and clamped in position to the support members at spaced intervals along the stairway;

FIG. 3 is another fragmentary view enlarged of the preferred apparatus of the present invention with assembled laminated strips clamped in position at one of the support members; and FIG. 4 is an exploded view illustrating in more detail the assembly of the series of laminated strips and profile forms used in the fabrication of a curved rail section.

DETAILED DESCRIPTION OF THE PREFERRED EMBODIMENT

Referring in more detail to the drawings, there is shown by way of illustrative example in FIG. 1 a curved stairway generally designated at S and wherein the individual stairs are made up of a tread portion T and riser R and extend between opposite curved sidewalls W and W' extending downwardly from an upper balcony or landing L to a lower floor surface, not shown. It is to be understood that the foregoing description of the stairway is merely representative of various curved or spiral staircases and is provided only as a setting for a description of the preferred method and apparatus of the present invention.

FIG. 4 illustrates in exploded form the make-up of a profile rail section 10 to be fabricated and bent into the desired conformation or curvature for the stairway S. In the particular rail section 10 as illustrated, elongated strips of wood 12 are of generally rectangular configuration with their longer dimensions as designated at d extending vertically and narrow dimensions or widths n extending horizontally. As seen, the side surfaces of each strip are disposed in facing relation to one another. In accordance with conventional practice, an adhesive or glue, not shown, is applied to one side only of two confronting side surfaces to be adhered together. In addition, outside profile strips of wood 14 have inner flat side surfaces along the longer dimension d and which are adhered to the intermediate strips 12. The strips 12 and 14 preferably are sandwiched between a pair of reverse profile forms 15 and 16 which traverse the length of the strips 12 and 14. For example, the strips 12, 14 as well as the forms 15 and 16 will be dimensioned to be of a length to traverse the total length of the stairway. However, in a manner to be described, the strips 12 and 14 comprising the rail section are not assembled or glued together except as a part of the on-site fabrication process.

In carrying out the method of the present invention, no special formers or molds are required to bend the rail section 10 into the desired curvature. Instead, vertical support members 20 are anchored to the tread portions T of the stairway along the path of intended curvature and placement of the rail section. As a result, the support members 20 are positioned at substantially equally spaced intervals along the length of the rail sections from the upper landing L to the lower floor surface. In the form shown in FIGS. 1 to 3, the support members 20 are defined by right angle brackets having horizontal legs 21 anchored to the tread portions T and vertical legs 22 extending upwardly to a convenient working height for placement of the rail section. Spaced upper and lower pressure pads 24 and 25, respectively, extend horizontally across the transverse dimension of the top and bottom surfaces of the rail section 10, as illustrated in FIG. 3, to prevent twisting of the strips and to retain them in aligned position between the profile forms 15 and 16. Preferably, the pressure pads 24 and 25 define opposite sides of a generally U-shaped or channel-shaped bracket 26 which includes a closed end 27 and an open end or entrance 28 between the free ends of the sides 24 and 25 for lateral insertion of the assembled rail section 10. The width of the bracket 26; i.e., the dimension between facing sides of the pressure pads 24 and 25 corresponds to the longer dimension d of the strips.

As noted from FIG. 2, a bracket 26 is associated with each vertical leg 22 by clamping the closed end 27 of each bracket together with the assembled rail section firmly against an inner surface of the leg 22 by means of a clamping member 30. Each clamping member 30 may suitably be in the form of a C-clamp having one end 32 bearing against the outer surface of the leg 22 and a threadedly adjustable stem 33 at the opposite end bears directly against the outer surface of the profile form 16. Correspondingly, C-clamps 34 can be utilized to anchor the legs 21 to the tread portions T, as shown in FIG. 2. In the alternative, as shown in FIG. 3, screws 36 can be utilized to anchor the horizontal legs 21 to the tread portions T. Additional C-clamps as designated at 37 and 38 may be positioned to exert either a laterally directed compressive force or a vertically directed force against the rail section intermediately between the brackets 26. In practice, however, it is important that the brackets 26 be anchored to the vertical legs 22 at a height or spacing above the tread portions which will assure that the rail section will assume the desired curvature for a given pitch or slope of the stairway. Of course, the rail section 10 must be allowed to cure or set up for a number of hours depending upon the particular bonding agent or glue employed and which will assure that the laminated sections will assume the desired configuration and pitch of the stairway. Once cured, standard ballusters and newels can be used to support the handrail at the desired height and are positioned in place along the tread portions, and the handrail 10 is attached in place in a well-known manner.

In accordance with the present invention, the preferred method of bending the laminated strips 12, 14 and forming them into a unified rail section of the desired curvature consists of the steps of joining the elongated strips of wood of a predetermined length with their longer dimensions in juxtaposed relation to one another to define the desired cross-sectional configuration of the rail section 10 and with the longer dimension d disposed normal to the major curvature of the rail section. The upstanding support members 20 are positioned at equally spaced intervals along the length of the stairway S for which the rail section 10 is being formed, and the lower legs 21 of the support members are anchored to the tread portions T along the path or line of intended curvature. A bonding agent or glue is applied to one of the facing surfaces of the elongated strips 12 and 14 and these strips are sandwiched together between the profile forms 15 and 16. It is important to avoid accidental placement of glue between the profile forms 15 and 16 and the strips 14; it is important also that a glued side of a strip be applied against an unglued side and that the glue be applied starting in the middle preferably with two persons applying glue so as to work from the middle toward each end. Most desirably, string ties are placed over the assembled rail section once glued to maintain proper alignment of the sections as a preliminary to clamping them to the support members.

Starting from the middle of the bend, a leveling bracket 26 is placed around the rail set and clamped to the vertical leg 21 of an intermediate support member 20 and lightly clamped into position. With one person advancing in each direction away from the center, each successive leveling bracket 26 is lightly clamped together with the rail set following which the spacing is checked between the rail and tread portions T to be certain that the height or spacing is equal throughout the entire length. Returning to the middle and working in each direction toward each end, the clamps 36 are positioned intermediately between the brackets 26, as illustrated in FIG. 2, and are tightened along with the clamps 30. If there is any indication that the pressure of the laminated wood strips is causing the pressure pads 24 or 25 of any bracket 26 to spring "out of level", a C-clamp 37 may be vertically clamped over the leveling bracket 26 to assure that the tabs 24 and 25 remain parallel or level.

The necessary clamping time for curing will vary but it is recommended that the clamps 30 not be removed for at least twenty-four hours following which the clamps are removed and rail laid along a premarked center line for at least thirty minutes to assure that it has assumed the proper curvature. If not, it may be necessary to reset the rail section 10 into the leveling brackets 26 and permit to cure for another twenty-four to forty-eight hours since the glue may have dried on the outside but not on the inside. The drying process can be accelerated with a heat tape and insulation wrap around the rail if desired.

Once properly cured, the rail section 10 can be finished by sanding and reshaping to the desired profile and scraping off any excess glue from the top and bottom of the rail section 10. A power sander can be used to shape and clean the top and bottom of the rail, following which the fittings are attached and any finish sanding can be done by hand or with a belt sander. Standard procedures can be followed for installing the ballusters and newel.

It should be noted that support members 20 and forming brackets 26 should be spaced equally along the entire length of the rail section. In setting the rail brackets 26, these should be located to conform to the center line of the rail plus any springback or memory of the rail section 10.

Prior to gluing and assembly, it is desirable to preset all clamps to the approximate size. The laminated strips 12 and 14 as well as the reverse profile forms 15 and 16 should be spread apart and the profile forms 15 and 16 sprinkled with a talcum powder to allow for slippage. Parafin or wax on the top and bottom edges will keep excess glue from sticking, and again it is important that glue not be accidentally applied to the profile forms. Quality glue should be employed, such as, a Titebond Type B or Type 50 glue.

From the foregoing, an on-site bending and forming operation has been described for use in conjunction with a specific cross-sectional configuration of rail. However, it will be evident that the method and apparatus as described is readily conformable for use with numerous types of rail cross-sections and styles. Moreover, while a solid rail section has been illustrated and described, the method and apparatus of the present invention is adaptable for use with hollow core rails.

It is therefore to be understood that while a preferred method and apparatus has been illustrated and described herein, various other modifications and changes may be made without departing from the spirit and scope of the present invention as defined by the appended claims and reasonable equivalents thereof.

We claim:

1. The method of compound bending of laminated wooden beam members into a curved rail section comprising the steps of:

assembling elongated strips of wood of a predetermined length in juxtaposed relation to one another;

positioning upstanding support members at longitudinally spaced intervals along the path of intended curvature;

applying adhesive between said strips and securing said strips together in juxtaposed relation to one another;

positioning retaining members on said support members to engage top and bottom edges of said elongated strips whereby to prevent twisting of said strips when a lateral force is applied;

clamping said strips and each said retaining member laterally against each said support member so as to apply pressure uniformly across the transverse dimension of said strips; and curing said strips together into a curved rail section.

2. The method according to claim 1, wherein said elongated strips have a longer dimension disposed normal to the major curvature of a completed rail section.

3. The method according to claim 1, including the step of anchoring said retaining members to said support members at a predetermined slope corresponding to the desired pitch of said rail section.

4. The method according to claim 1, including the step of clamping said strips together intermediately between said support members.

5. The method according to claim 1, including the step of placing profile forms on opposite sides of said strips as a preliminary to clamping said strips against each said support member.

6. The method according to claim 1, including the step of applying pressure across the lateral dimension of said elongated strips to prevent twisting of said strips away from horizontal.

7. The method according to claim 1, including the step of positioning said support members at longitudinally spaced intervals along a curved stairway for which the rail section is to be formed and anchoring said support members to said stairway along the path of intended curvature.

8. The method according to claim 7, said elongated strips being generally rectangular in cross-section and having their longer dimensions disposed normal to the major curvature of said rail section.

9. Apparatus for compound bending of laminated wooden beam members into a curved handrail section for a curved stairway, comprising:

support members including means anchoring said support members to tread portions of said stairway such that said support members are disposed along a desired path of curvature of said handrail; and pressure-applying means associated with each of said support members for maintaining said strips in horizontally aligned relation to one another, said pressure-applying means defined by generally channel-shaped members having horizontally extending sides disposed in vertically spaced relation to one another and at an angle corresponding to the pitch of said stairway, and means for applying a laterally directed pressure to said strips whereby to clamp said strips firmly against each of said support members.

10. Apparatus according to claim 9, said support members defined by right angle brackets having horizontally extending portions and vertical legs, and means for anchoring said horizontally extending portions to the treads portions of said stairway.

11. In apparatus for compound bending laminated woden beam members into a handrail having a predetermined pitch and curvature, said beam members defined by elongated strips of wood having their longer cross-sectional dimension extending in a direction normal to the curvature of said handrail, an adhesive being applied between said laminated strips whereby said strips can be adhered together into a unitary rail section, the improvement comprising:

a plurality of vertical support members;

means anchoring each said support member along a predetermined path of curvature corresponding to the intended curvature of said handrail;

leveling means extending horizontally from each said support member along a predetermined slope and including upper and lower vertically spaced pressure pads whereby said wooden beam members are inserted between said pressure pads and are retained in a level disposition; and clamping means for clamping said wooden beam members together between said pressure pads and said leveling means as said beam members are adhered together into a unitary rail section.

12. In apparatus according to claim 11, said leveling means each defined by a generally channel-shaped bracket having a closed end abutting one of said vertical support members and said pressure pads defining opposite sides of each said bracket, said opposite sides terminating in an open end opposite to said closed end for lateral insertion of said beam members.

13. In apparatus according to claim 12, said opposite sides of each said bracket extending along a predetermined slope corresponding to the intended pitch of said rail section.

* * * * *